US010259136B2

(12) United States Patent
Liu

(10) Patent No.: US 10,259,136 B2
(45) Date of Patent: Apr. 16, 2019

(54) MULTI-BLADE CUTTING STRIP AND CUTTER FOR WOOD PLANING MACHINE

(71) Applicant: Shinmax Industry Co., Ltd., Taichung (TW)

(72) Inventor: Chin-Yuan Liu, Taichung (TW)

(73) Assignee: Shinmax Industry Co., Ltd., Taichung (TW)

( * ) Notice: Subject to any disclaimer, the term of this patent is extended or adjusted under 35 U.S.C. 154(b) by 417 days.

(21) Appl. No.: 14/748,394

(22) Filed: Jun. 24, 2015

(65) Prior Publication Data

US 2015/0375417 A1 Dec. 31, 2015

(30) Foreign Application Priority Data

Jun. 25, 2014 (TW) ..... 103211271 U

(51) Int. Cl.
*B27G 13/04* (2006.01)

(52) U.S. Cl.
CPC ..... *B27G 13/04* (2013.01)

(58) Field of Classification Search
CPC ..... B27C 1/00; B27C 1/005; B27C 1/007; B27C 1/02; B27C 1/04; B27C 1/06; B27C 1/08; B27C 1/14; B27G 13/00; B27G 13/02; B27G 13/04; B27G 13/06; B27G 13/08; B27G 13/10; B27G 13/12; B23G 2200/10; Y10T 407/1628; B23D 71/005
See application file for complete search history.

(56) References Cited

U.S. PATENT DOCUMENTS 4,253,506 A * 3/1981 Shimohira ..... B27G 13/04 144/117.1
6,626,214 B1 * 9/2003 Hu ..... B27G 13/04 144/117.1
7,048,476 B2 * 5/2006 Misenheimer ..... B23C 5/08 407/67
9,038,933 B2 * 5/2015 Fredsall ..... B02C 18/145 241/300

* cited by examiner

*Primary Examiner* — Matthew Katcoff
(74) *Attorney, Agent, or Firm* — Trop Pruner & Hu, P.C.

(57) ABSTRACT

A cutter includes a rotary shaft having a longitudinal axis and a plurality of circumferentially spaced-apart multi-blade cutting strips each of which includes a plurality of cutting blades spacedly provided at at least one longitudinal side edge of a cutting strip body thereof. Each cutting blade of each cutting strip has a portion (P1) staggered with respect to an adjacent cutting blade of an adjacent cutting strip along a circumferential direction around the longitudinal axis, and a remaining portion (P2) aligned with the adjacent cutting blade of the adjacent cutting strip along the circumferential direction. The portion (P1) has an offset length (D) measured along the longitudinal direction.

15 Claims, 10 Drawing Sheets

MULTI-BLADE CUTTING STRIP AND CUTTER FOR WOOD PLANING MACHINE

CROSS REFERENCE TO RELATED APPLICATION

This application claims priority of Taiwanese Application Number 103211271, filed on Jun. 25, 2014.

FIELD

The disclosure relates to a planing blade of a wood planing machine, more particularly to a multi-blade cutting strip and a cutter for the wood planing machine.

BACKGROUND

Referring to FIG. 1, a conventional cutter for a wood planing machine, as disclosed in U.S. Pat. No. 4,538,655, includes a rotary shaft 11 extending along a longitudinal direction and rotatable about an axis, a plurality of cutting strips 12 and a plurality of fasteners 13. The cutting strips 12 are elongated, are parallel to the axis, and are circumferentially disposed on the shaft 11. The fasteners 13 respectively fix the cutting strips 12 on the shaft 11.

During the planing process, the whole piece of each cutting strip 12 is in contact with a to-be-planed surface of a workpiece. Because a contact area between each cutting strip 12 and the to-be-planed surface of the workpiece is large, when the shaft rotates in high speed, each cutting strip 12 imposes a high impact against the to-be-planed surface. Aside from producing a large sound or noise, because the resistance is large, a huge amount of energy is consumed, so that the work efficiency is reduced. Further, each cutting strip 12 is easily damaged.

FIG. 2 illustrates another conventional cutter of a wood planing machine. The conventional cutter includes a rotary shaft 21, a plurality of cutting blades 22 and a plurality of fasteners 23. The shaft includes a plurality of circumferentially spaced-apart spiral side surfaces 211 extending along a longitudinal direction. The cutting blades 22 are disposed on the spiral side surfaces 211. Each fastener 23 extends through a respective one of the cutting blades 22 and engages a corresponding spiral side surface 211 to thereby fix each cutting blade 22 on the shaft 3.

The cutting blades 22 are small in size and are disposed in the spiral side surfaces 211 of the shaft 21. Thus, a contact area between the cutting blades 22 and a to-be-planed surface of a workpiece is reduced. After each cutting blade 22 planes a small region of the to-be-planed surface, a next one of the cutting blades 22 continues the planing process. This can effectively decrease the noise and the resistance produced during planing of the to-be-planed surface of the workpiece. However, because the shaft 21 needs to go through a fine processing so that the side surfaces 211 thereof extend in a spiral manner, and because the cutting blades 22 are small in size so that it is difficult to manufacture and process the same, a high investment is thus required for the manufacture and process of the shaft 21 and the cutting blades 22.

SUMMARY

Therefore, an object of the present disclosure is to provide a multi-blade cutting strip which has a reduced processing cost.

Accordingly, a multi-blade cutting strip of this disclosure comprises a cutting strip body extending along a longitudinal direction and having two opposite longitudinal side edges, a plurality of cutting blades spacedly provided at at least one of the longitudinal side edges, and a plurality of spacer sections each formed between two adjacent ones of the cutting blades. Each of the cutting blades has a blade edge extending along the longitudinal direction.

Another object of this disclosure is to provide a cutter which has a reduced cost and which can decrease noise and resistance during planing.

Accordingly, a cutter comprises a rotary shaft having a longitudinal axis, and a plurality of circumferentially spaced-apart multi-blade cutting strips disposed on an outer surface of the rotary shaft. Each of the multi-blade cutting strips includes a cutting strip body extending along a longitudinal direction parallel to the longitudinal axis and having two opposite longitudinal side edges, a plurality of cutting blades spacedly provided at at least one of the longitudinal side edges, and a plurality of spacer sections each formed between two adjacent ones of the cutting blades. Each of the cutting blades has a blade edge extending straightly along the longitudinal direction. The cutting blades of each of the multi-blade cutting strips are respectively and circumferentially staggered with respect to the cutting blades of an adjacent one of the cutting strips. Each of the cutting blades of each of the multi-blade cutting strips has a portion (P1) staggered with respect to an adjacent one of the cutting blades of an adjacent one of the multi-blade cutting strips along a circumferential direction around the longitudinal axis, and a remaining portion (P2) aligned with the adjacent one of the cutting blades of the adjacent one of the multi-blade cutting strips along the circumferential direction. The portion (P1) has an offset length (D) measured along the longitudinal direction.

BRIEF DESCRIPTION OF THE DRAWINGS

Other features and advantages of the present disclosure will become apparent in the following detailed description of the embodiments with reference to the accompanying drawings, of which.

DETAILED DESCRIPTION

Figure 1:
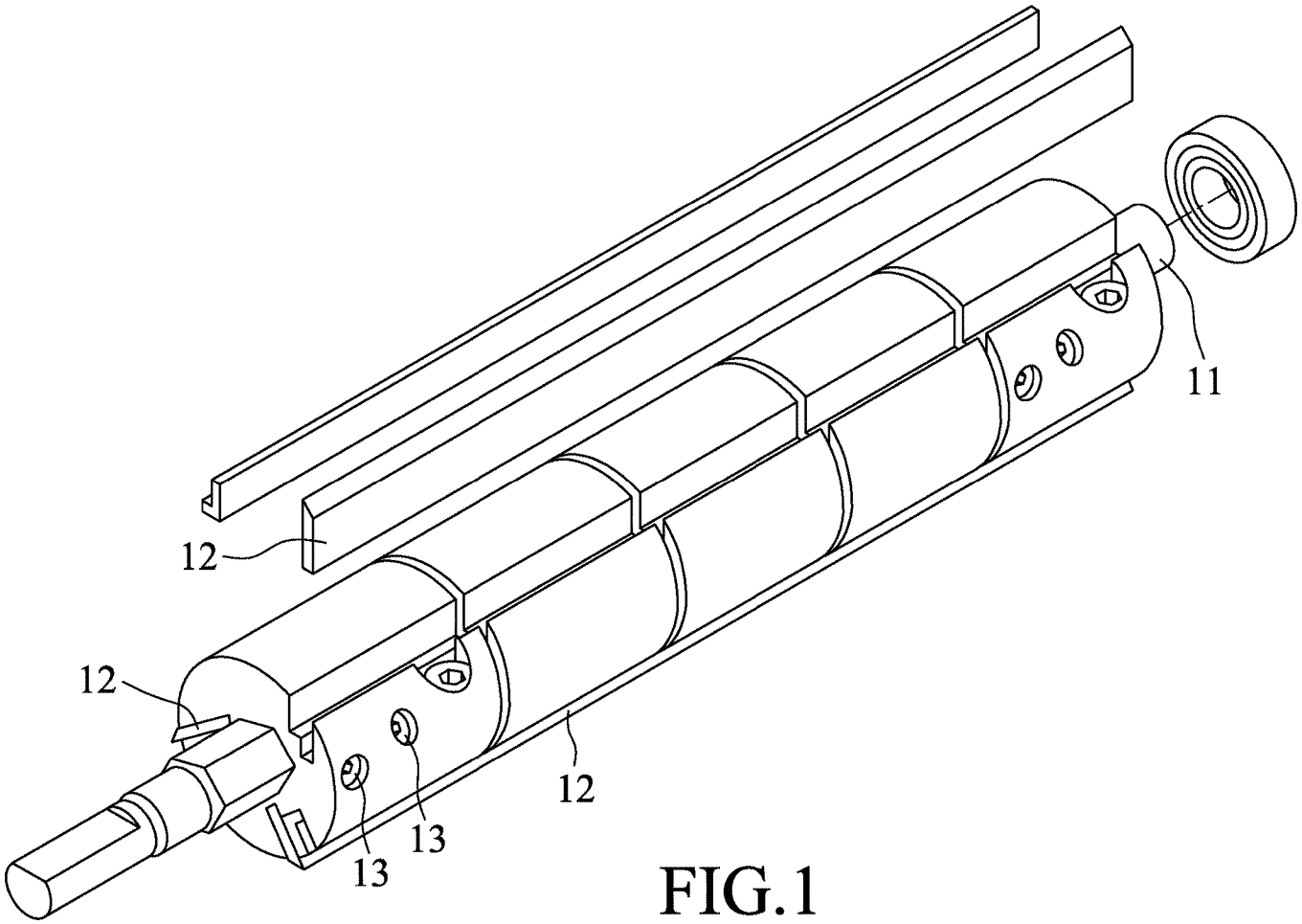
FIG.1 PRIOR ART
FIG. 1 is a partial perspective view of a conventional cutter disclosed in U.S. Pat. No. 4,538,655.
Figure 2:
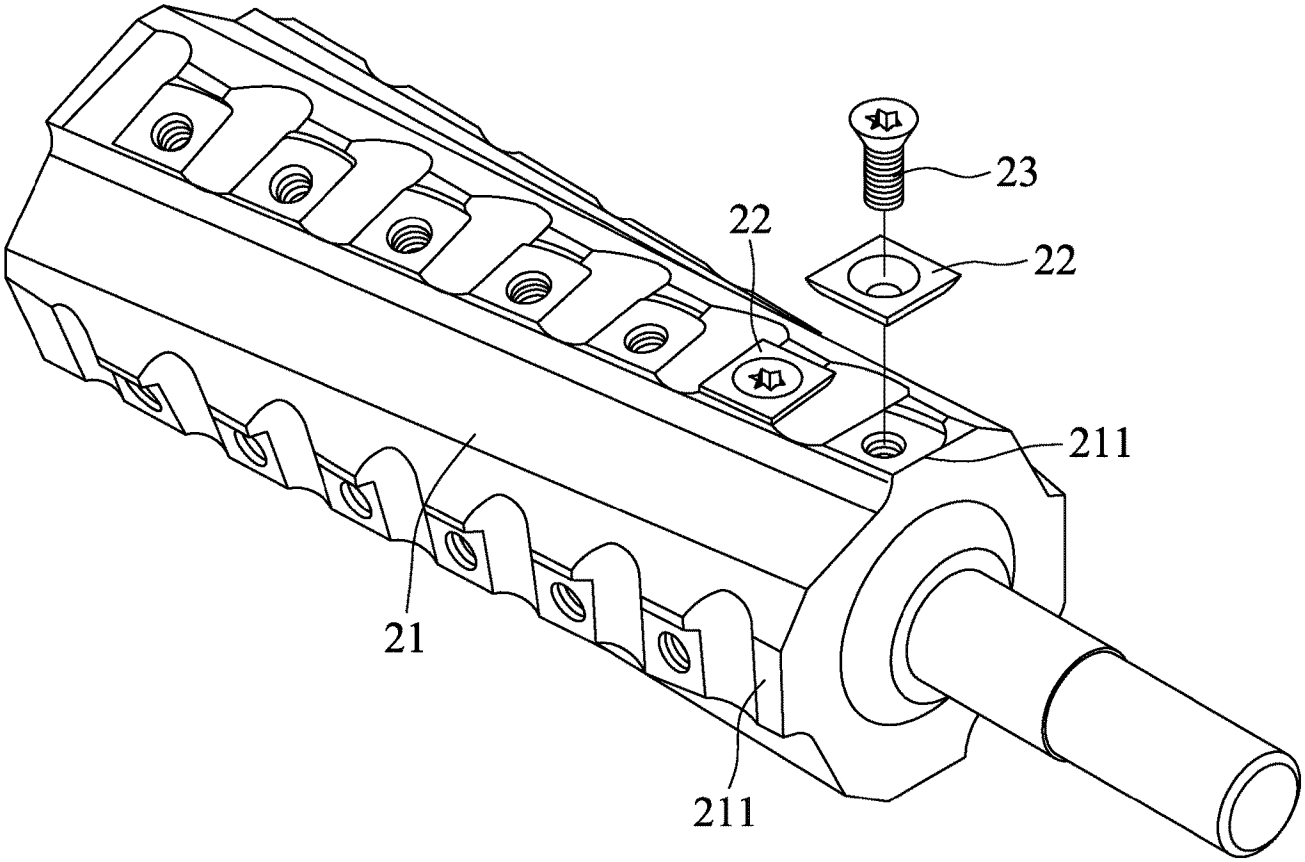
FIG.2 PRIOR ART
FIG. 2 is a perspective view of another conventional cutter.

Before the present disclosure is described in greater detail with reference to the accompanying embodiments, it should be noted herein that like elements are denoted by the same reference numerals throughout the disclosure.

Figure 3:
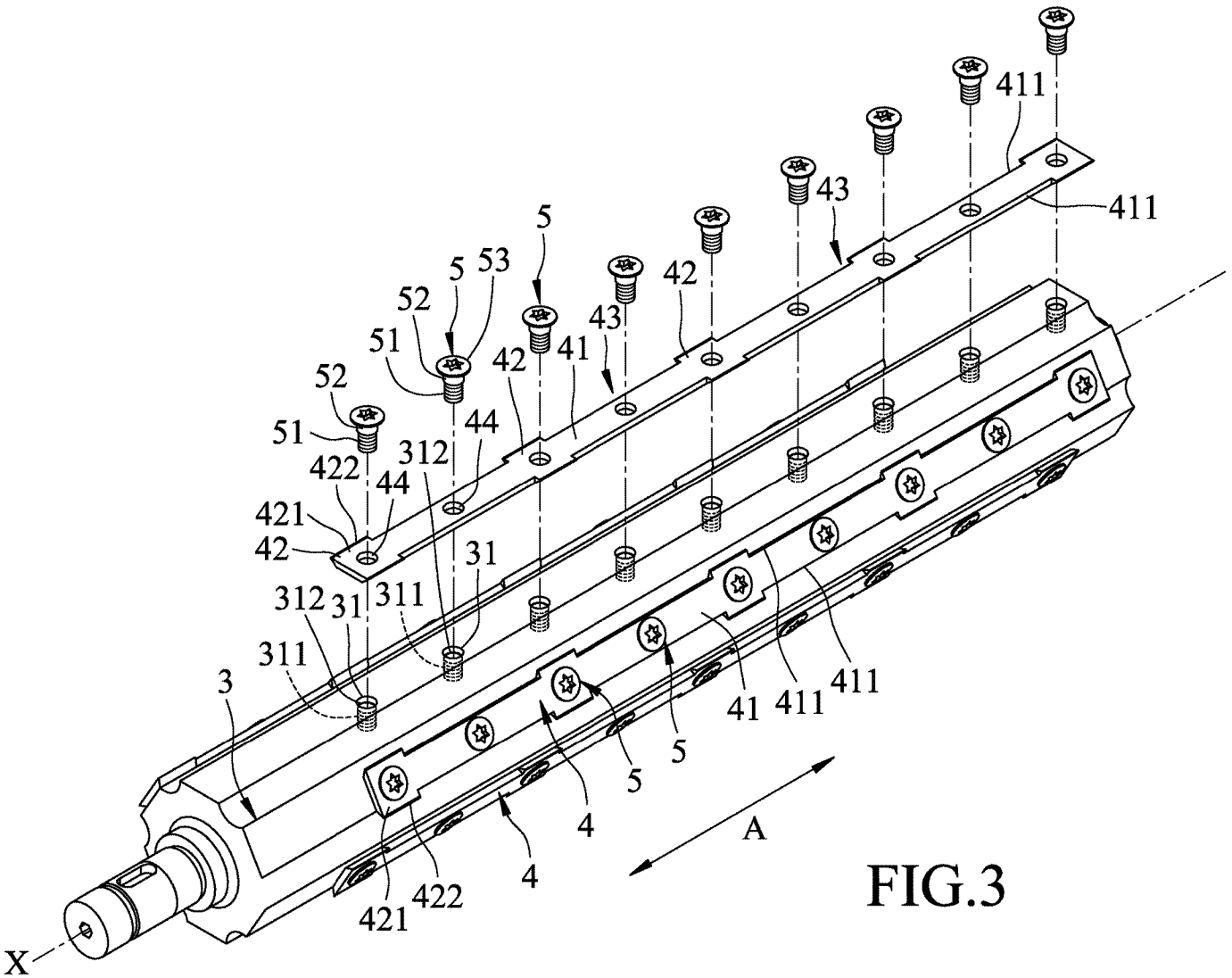
FIG. 3 is a partial exploded perspective view of the first embodiment of a cutter according to the present disclosure.
Figure 4:
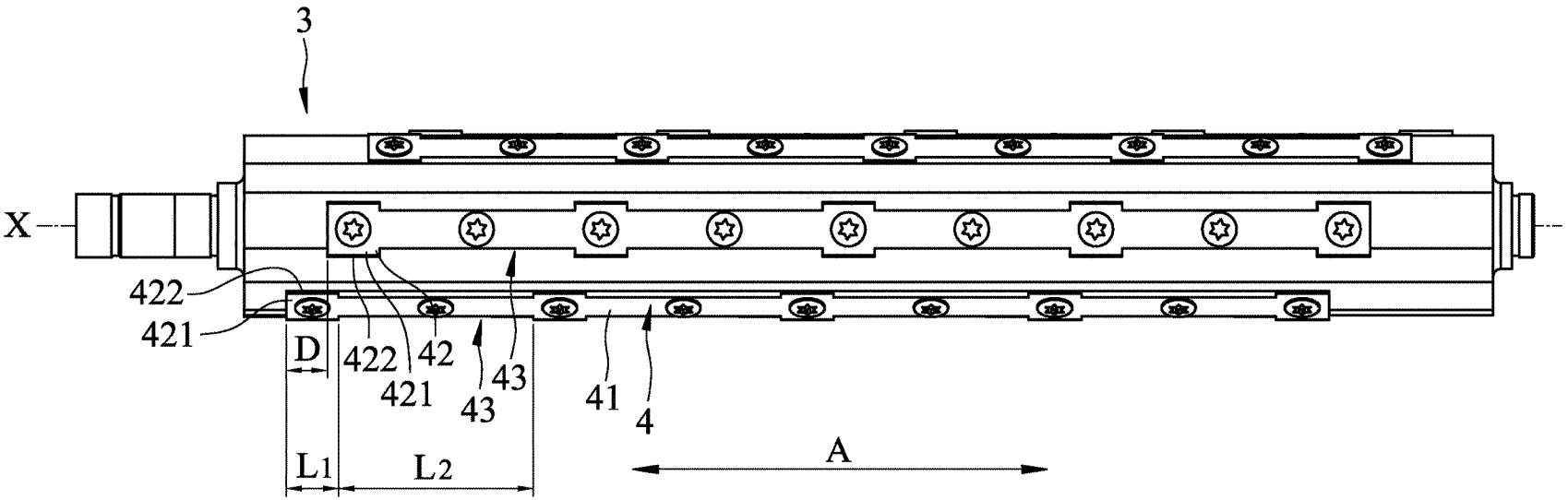
FIG. 4 is a schematic side view of the first embodiment in an assembled state.
Figure 4A:
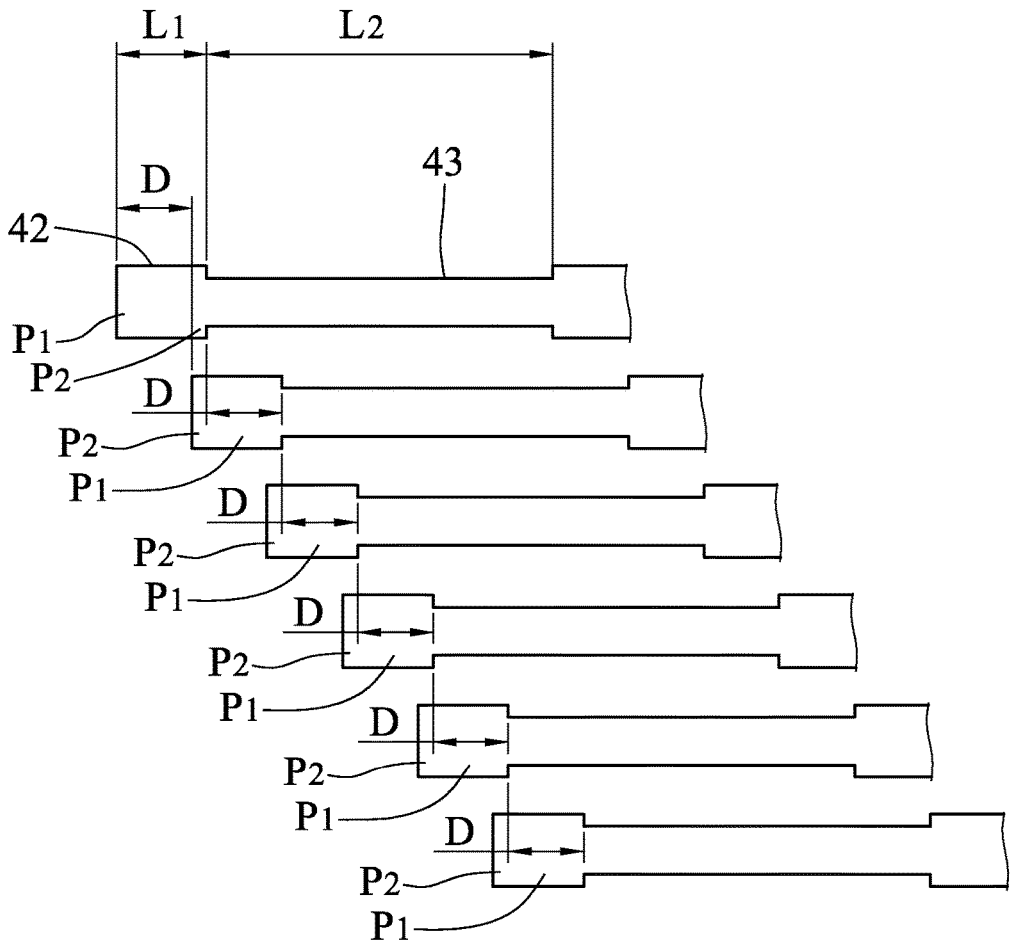
FIG. 4A shows a layout of circumferentially spaced-apart cutting strips transferred to a flat surface.

Referring to FIGS. 3, 4 and 4A, the first embodiment of a cutter according to the present disclosure is shown to comprise a rotary shaft 3, a plurality of multi-blade cutting strips 4, and a plurality of fasteners 5.

The rotary shaft 3 has a longitudinal axis (X) and is rotatable about its longitudinal axis (X). The rotary shaft 3 includes a plurality of circumferentially spaced-apart rows of fastening holes 31 formed in an outer surface thereof. The fastening holes 31 in each row are arranged in a spaced apart manner along the length of the shaft 3. Each of the fastening holes 31 has a screw hole portion 311, and a positioning hole portion 312 which has a diameter larger than that of the screw hole portion 311, which communicates with the screw hole portion 311 and which is located on an outer side of the screw hole portion 311.

The multi-blade cutting strips 4 are respectively disposed on the rows of the fastening holes 31. In this embodiment, the number of the cutting strip 4 is six. Each multi-blade cutting strip 4 includes a cutting strip body 41 extending along a longitudinal direction (A) parallel to the longitudinal axis (X) and having two opposite longitudinal side edges 411, a plurality of cutting blades 42 spacedly provided at both of the longitudinal side edges 411, a plurality of spacer sections 43 each formed between two adjacent ones of the cutting blades 42, and a plurality of fixing holes 44 extending through the cutting strip body 41 and spaced apart from each other along the length of the cutting strip body 41.

In this embodiment, each longitudinal side edge 411 is provided with five cutting blades 42. Each cutting blade 42 has a cutting blade body 421 extending outward from a corresponding longitudinal side edge 411 in a direction perpendicular to the longitudinal direction (A), and a blade edge 422 formed on the cutting blade body 421 and extending straightly along the longitudinal direction (A). The five cutting blades 42 cooperate with the corresponding longitudinal side edge 411 to define four spacer sections 43.

Each of the cutting blades 42 of each cutting strip 4 has a portion ($P_1$) staggered with respect to an adjacent one of the cutting blades 42 of an adjacent one of the cutting strips 4 along a circumferential direction around the longitudinal axis (X), and a remaining portion ($P_2$) aligned with the adjacent one of the cutting blades 42 of the adjacent one of the cutting strips 4 along the circumferential direction, as shown in FIG. 4A. The portion ($P_1$) has an offset length (D) measured along the longitudinal direction (A). The blade edge 422 of each cutting blade 42 has an axial length ($L_1$) larger than the offset length (D). During rotation of the shaft 3 about the axis (X), each cutting blade 42 of a leading one of the cutting strips 4 planes a region of a surface, and an adjacent one of the cutting blades 42 of an adjacent trailing cutting strip 4 succeeds planing another region overlapping with this region.

In this embodiment, the cutting blades 42 of the multi-blade cutting strips 4 are arranged in a helical array about the axis (X). The blade edge 422 of each cutting blade 42 of each cutting strip 4 is staggered with respect to the blade edge 422 of an adjacent one of the cutting blades 42 of a leading one of the cutting strips 4 by the offset length (D) when the shaft 3 rotates. As best shown in FIG. 4A, in combination with FIG. 4, each of the spacer sections 43 formed between two adjacent ones of the cutting blades 42 of one of the cutting strips 4 has an axial length ($L_2$) smaller than the sum of the offset lengths (D) of the portions ($P_1$) of the cutting blades 42 of the remaining cutting strips 4 that are staggered with the two adjacent ones of the cutting blades 42 in the circumferential direction and that are at least partially aligned with the axial length ($L_2$) in the circumferential direction. That is, five offset lengths (D) in one revolution of the shaft 3 about the axis (X) are larger than the axial length ($L_2$) of one spacer section 43. When the shaft 3 rotates one revolution about the axis (X), the amount of feed of the blade edges 422 of the cutting blades 42 of the cutting strips 4 is enough to plane areas not covered by the spacer sections 43.

Each of the fasteners 5 has a threaded shank section 51 for threaded engagement with the screw hole portion 311 of a respective fastening hole 31, a positioning shank section 52 for embedding in the positioning hole portion 312 of the respective fastening hole 31 and having a diameter larger than that of the threaded shank section 51, and a head 53 fixed to the positioning shank section 52 opposite to the threaded shank section 51 and exposed from the positioning hole portion 312 of the respective fastening hole 31.

During assembly, each fastener 5 extends through a respective fixing hole 44, and engages the corresponding fastening hole 31. Specifically, the threaded shank section 51 of each fastener 5 is detachably engaged to the respective fastening hole 31, and the positioning shank section 52 thereof is embedded in the respective fixing hole 44 and the positioning hole portion 312 of the corresponding fastening hole 31. The head 53 presses the cutting strip body 41 of the corresponding cutting strip 4 against the shaft 3. The positioning hole portion 312 and the positioning shank section 52 has a clearance smaller than that between the screw hole portion 311 and the threaded shank section 51. Through this, the cutting strip bodies 41 of the cutting strips 4 are tightly positioned on the shaft 3. Further, because the positioning shank section 52 of each fastener 5 is embedded in the respective fixing hole 44 and the positioning hole portion 312 of the corresponding fastening hole 31, a slight displacement of each cutting strip 4 relative to the shaft 3 along the longitudinal direction (A) may be prevented.

From the aforesaid description, the advantages of the first embodiment may be summarized as follows:

1. Through the relative disposition of the cutting blades 42 of the cutting strips 4, when the shaft 3 rotates one revolution about the axis (X), the regions planed by the cutting blades 42 of the cutting strips 4 overlap each other so that a whole region of the to-be-planed surface can be planed by the cutting strips 4 without interruption.

2. Through the short configurations of the cutting blades 42 of the cutting strips 4 and through the helical arrangement of the blade edges 422, when the shaft 3 rotates to plane the to-be-planed surface (not shown), a contact surface between the blade edges 422 and the to-be-planed surface can be reduced, thereby reducing the resistance and the noise produced during planing.

3. The fixing of the single cutting strip 4 on the shaft 3 of this disclosure uses a plurality of the fasteners 5, so that the fixing of the cutting strip is stable. Hence, the cutting strip 4 of this disclosure will not easily rotate or displace after prolonged use.

4. There is no need to preform the shaft 3 into a helical form using a fine process, it is only necessary to dispose the cutting strips 4 on the shaft 3 as described above to produce an effect similar to that of a helically shaped shaft. Thus, the cutter of this disclosure has a lower cost as compared to that of the conventional cutter.

It is worth mentioning that the cutting strips 4 may be independently manufactured and sold. When the cutting strips 4 are damaged, they can be easily replaced.

Figure 5:
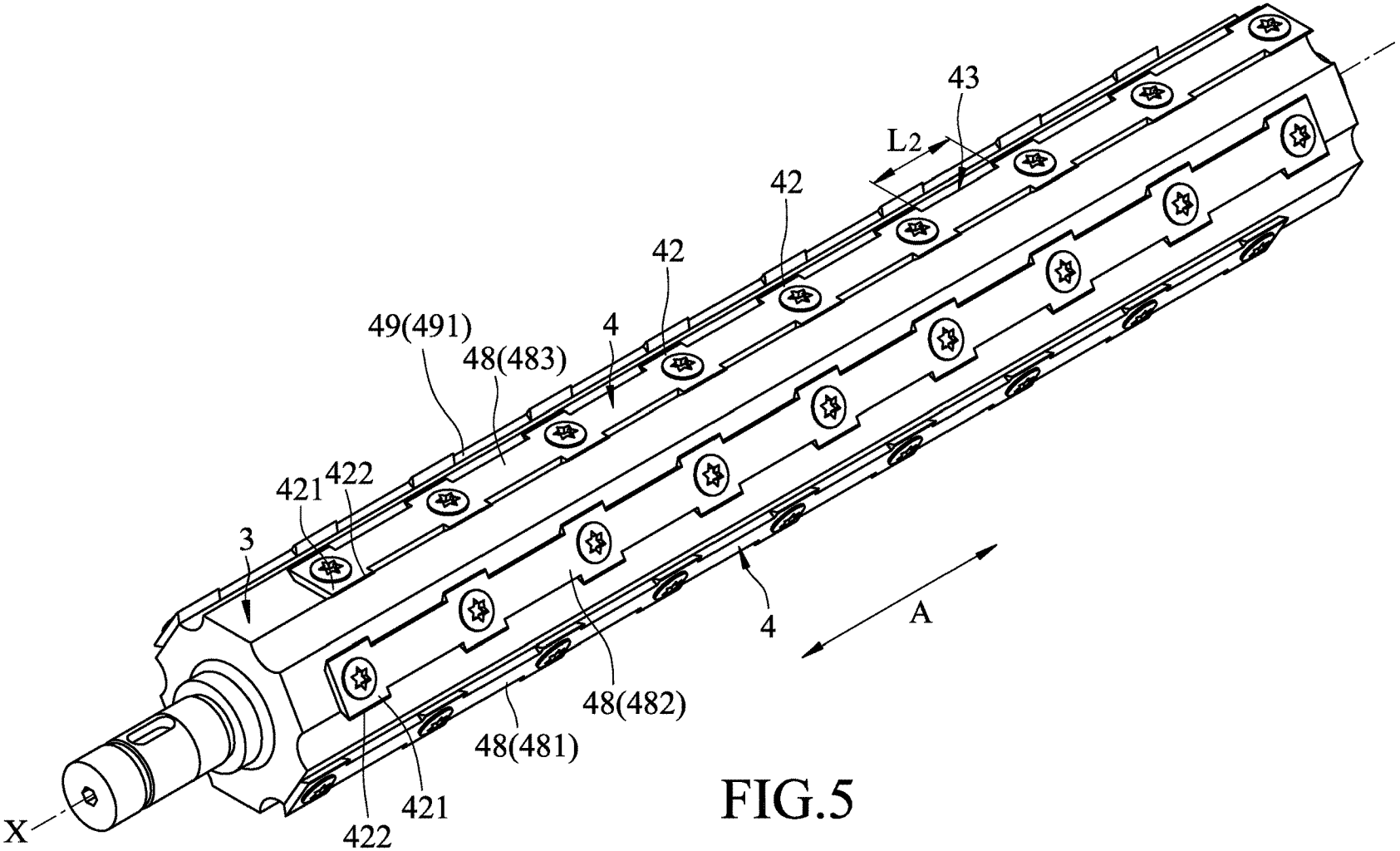
FIG. 5 is a perspective view of the second embodiment of a cutter according to the present disclosure.
Figure 6:
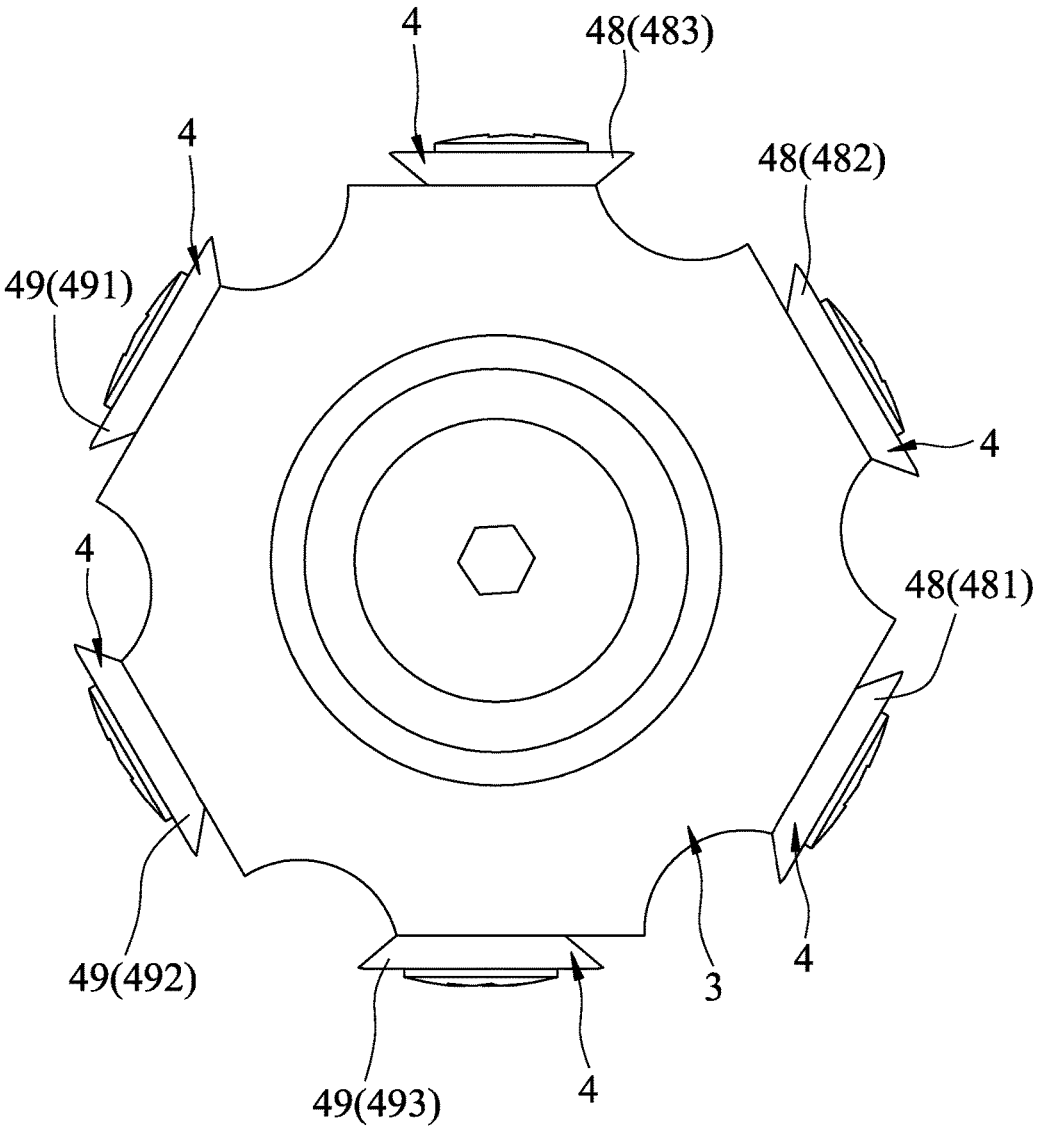
FIG. 6 is a schematic front view of the second embodiment, illustrating a relative position of two cutting strip groups.

Referring to FIGS. 5 and 6, a cutter according to the second embodiment of the present disclosure is shown to be similar to the first embodiment. However, in this embodiment, the multi-bladed cutting strips 4 are divided into a first cutting strip group 48 and a second cutting strip group 49 disposed on two opposite sides of the rotary shaft 3. The first cutting strip group 48 includes three multi-blade cutting strips 481, 482, 483. The second cutting strip group 49 includes three multi-blade cutting strips 491, 492, 493. Each longitudinal side edge 411 of each multi-blade cutting strip 481, 482, 483, 491, 492, 493 is provided with nine cutting blades 42. The cutting blades 42 of one of the cutting strips 481, 482, 483 are aligned with the cutting blades 42 of the other one of the cutting strips 491, 492, 493, respectively, along the circumferential direction. The blade edges 422 of the cutting blades 42 of each cutting strip 481, 482, 483, 491, 492, 493 in each of the first or second cutting strip group 48, 49 are respectively staggered with respect to the blade edges 422 of the cutting blades 42 of an adjacent leading one of the cutting strips 481, 482, 483, 491, 492, 493 in the corresponding first or second cutting strip group 48, 49 by the offset length (D) (see FIG. 4) when the rotary shaft 3 rotates.

In each of the first and second cutting strip groups 48, 49, each of the spacer sections 43 formed between two adjacent ones of the cutting blades 42 of one of the cutting strips 481, 482, 483, 491, 492, 493 has the axial length ($L_2$) not larger than the sum of the offset lengths (D) of the portions ($P_1$) (see FIG. 4A) of the cutting blades 42 of the remaining cutting strips 481, 482, 483, 491, 492, 493 that are staggered with the two adjacent ones of the cutting blades 42 in the circumferential direction and that are at least partially aligned with the axial length ($L_2$) in the circumferential direction.

In this embodiment, the cutting blades 42 of the cutting strips 481, 482, 483, 491, 492, 493 of each of the first and second cutting strip groups 48, 49 forma semi-helical configuration. Because the cutting blades 42 of the cutting strips 481, 482, 483 correspond in position to the cutting blades 42 of the cutting strips 491, 492, 493, respectively, when the shaft 3 rotates one revolution about the axis (X), the to-be-planed surface will be planed twice at the same region by the blade edges 422 of the cutting blades 42 of the cutting strips 481, 482, 483, 491, 492, 493 of the first and second cutting strip groups 48, 49. As such, the object and the advantages described in the first embodiment can be similarly achieved using the second embodiment. Further, because the effect of planing twice the to-be-planed surface during one revolution rotation of the shaft 3, the flatness of the planed surface can be enhanced, as well as the working efficiency of planing the to-be-planed surface.

Figure 7:
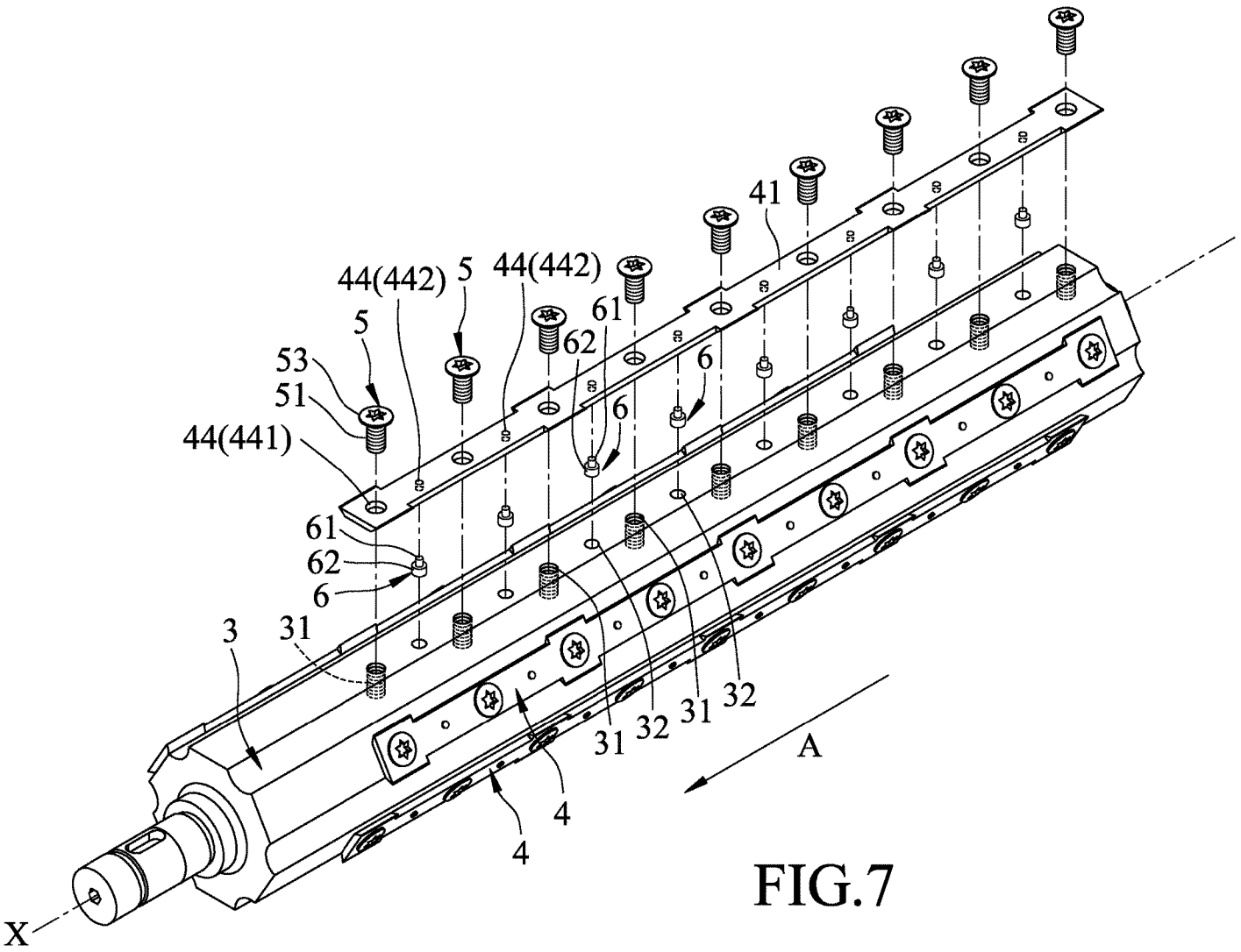
FIG. 7 is a partial exploded perspective view of the third embodiment of a cutter according to the present disclosure.

Referring to FIG. 7, a cutter according to the third embodiment of the present disclosure is shown to be similar to the first embodiment. However, in this embodiment, the cutter further comprises a plurality of positioning members 6, each fastener 5 only includes a head 53 and a threaded shank section 51, and the rotary shaft 3 further includes a plurality of positioning holes 32 for receiving the positioning members 6, respectively. Each positioning hole 32 is disposed between two adjacent ones of the fastening holes 31. The fixing holes 44 in the cutting strip body 41 of each multi-blade cutting strip 4 are divided into a plurality of first fixing holes 441 for extension of the threaded shank sections 51 of the fasteners 5 respectively therethrough, and a plurality of second fixing holes 442 corresponding in position to the positioning holes 32, respectively. Each second fixing hole 442 is disposed between each two adjacent ones of the first fixing holes 441. The threaded shank section 51 of each fastener 5 extends through the respective first fixing hole 441 and engages the respective fastening hole 31 during assembly.

Each positioning member 6 includes an embedded portion 62 embedded in the respective positioning hole 32, and a protruding portion 61 protruding from the embedded portion 62 and extending through the respective second fixing hole 442. The embedded portion 62 has a diameter larger than that of the respective second fixing hole 442. The protruding portion 61 of each positioning member 6 and a periphery of the respective second fixing hole 442 has a clearance smaller than that between each fastener 5 and a periphery of the respective first fixing hole 441. As such, the object and the advantages described in the first embodiment can be similarly achieved using the third embodiment.

Figure 8:
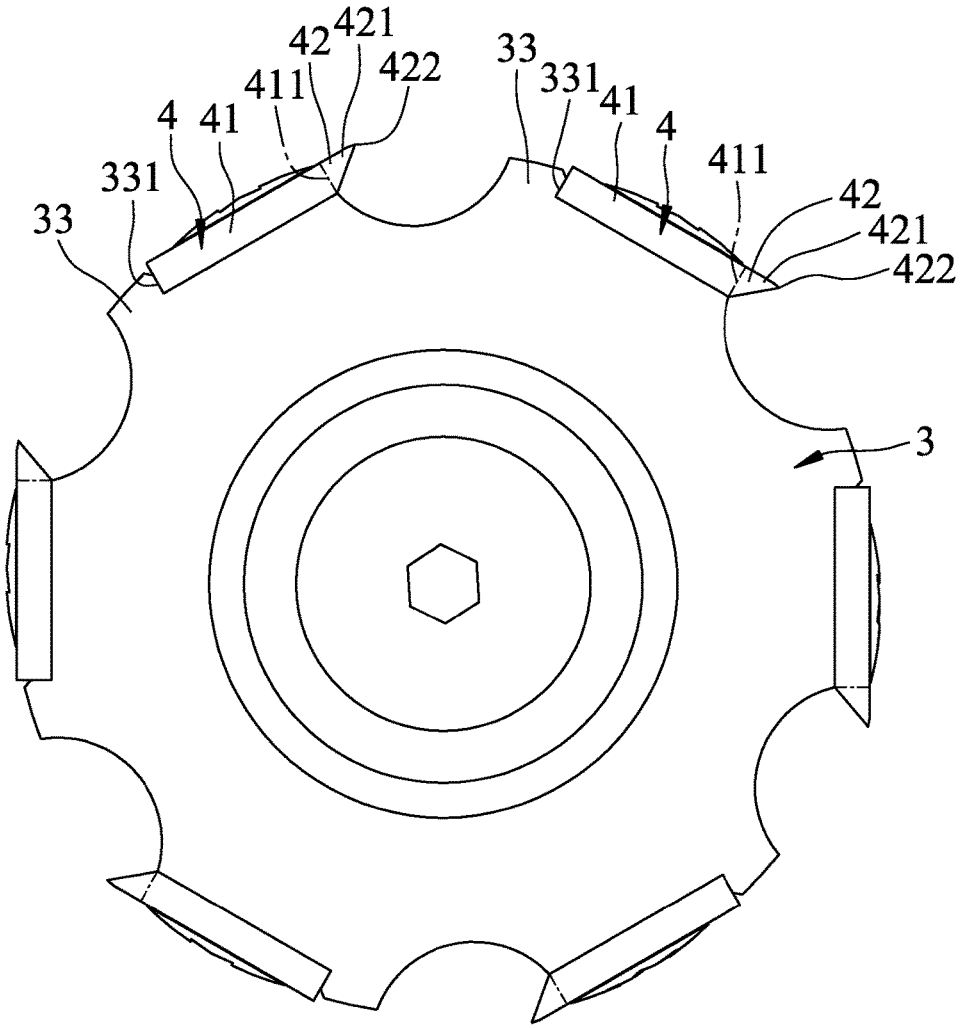
FIG. 8 is a schematic front view of the fourth embodiment of a cutter according to the present disclosure.

Referring to FIG. 8, a cutter according to the fourth embodiment of the present disclosure is shown to be similar to the first embodiment. However, in this embodiment, the rotary shaft 3 further includes a plurality of circumferentially spaced-apart abutment portions 33 disposed on and projecting outward from the outer surface of the shaft 3. Each of the abutment portions 33 extends in the longitudinal direction (A). Only one longitudinal side edge 411 of the cutting strip body 41 of each multi-blade cutting strip 4 is provided with the cutting blades 42. Each abutment portion 33 has an abutment surface 331 abutting against the cutting strip body 41 of the respective cutting strip 4. It will be appreciated that the abutment surface 331 of each abutment portion 33 abuts against the cutting strip body 41 of the respective cutting strip 4 at a side opposite to the cutting blade 42.

The object and the advantages described in the first embodiment can be similarly achieved using the fourth embodiment. With the abutment portions 33 abutting against the cutting strip body 41 of the respective cutting strips 4, the stability of the cutting strips 4 can be enhanced.

Figure 9:
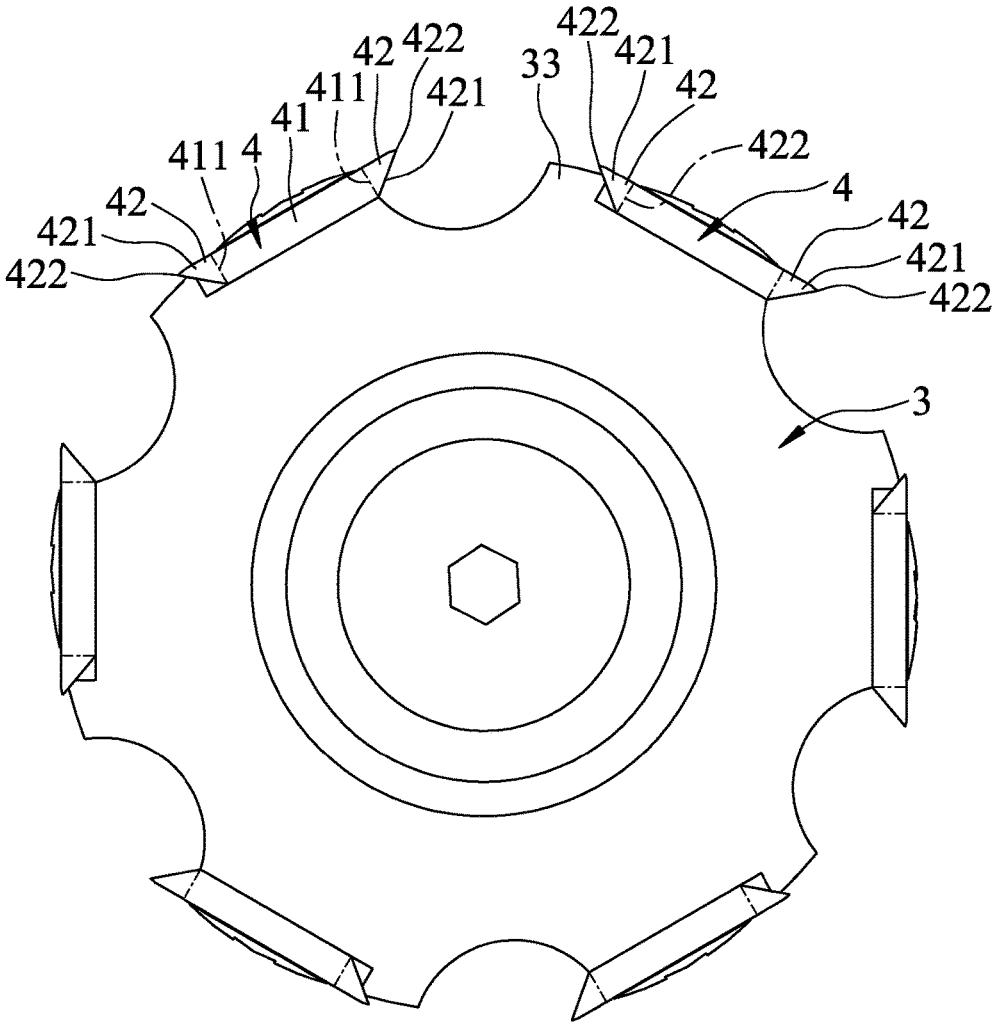
FIG. 9 is a schematic front view of the fifth embodiment of a cutter according to the present disclosure.

Referring to FIG. 9, a cutter according to the fifth embodiment of the present disclosure is shown to be similar to the first embodiment. However, in this embodiment, the rotary shaft 3 further includes a plurality of circumferentially spaced-apart abutment portions 33 disposed on and projecting outward from the outer surface of the shaft 3. Each of the abutment portions 33 extends in the longitudinal direction (A), and abuts against the cutting blade bodies 421 of the cutting blades 42 located at the same longitudinal side edge 411 of the respective cutting strip 4 along a tangential direction.

The object and the advantages described in the first embodiment can be similarly achieved using the fifth embodiment. With the abutment portions 33 abutting against the cutting blade bodies 421 of the cutting blades 42 of the respective cutting strips 4, the stability of the cutting strips 4 can be enhanced.

While the present disclosure has been described in connection with what are considered the most practical embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A cutter, comprising:

a rotary shaft having a longitudinal axis; and a plurality of circumferentially spaced-apart multi-blade cutting strips disposed on an outer surface of said rotary shaft, each of said multi-blade cutting strips including a cutting strip body straightly extending along a longitudinal direction parallel to said longitudinal axis and having two opposite longitudinal side edges, a plurality of cutting blades spacedly provided at at least one of said longitudinal side edges, and a plurality of spacer sections each formed between two adjacent ones of said cutting blades, each of said cutting blades having a blade edge that is straight and parallel to the longitudinal axis of said rotary shaft;

wherein said cutting blades of each of said multi-blade cutting strips are respectively staggered with respect to said cutting blades of an adjacent one of said multi-blade cutting strips along a circumferential direction of a circumference of said rotary shaft, each of said cutting blades of each of said multi-blade cutting strips having a portion (P1) staggered with respect to an adjacent one of said cutting blades of an adjacent one of said multi-blade cutting strips along the circumferential direction, and a remaining portion (P2) aligned with the adjacent one of said cutting blades of the adjacent one of said multi-blade cutting strips along the circumferential direction, said portion (P1) having an offset length (D) measured along the longitudinal direction.

2. The cutter as claimed in claim 1, wherein said cutting blades of said cutting strips are staggered and arranged in a helical array in which a location of each of said cutting blades of each of said cutting strips is aligned with a location of one of said cutting blades of each of other ones of said cutting strips along a helical line.

3. The cutter as claimed in claim 1, further comprising a plurality of fasteners for securing each of said multi-blade cutting strips on said outer surface of said rotary shaft, said rotary shaft including a plurality of fastening holes formed in said outer surface, said cutting strip body further having a plurality of fixing holes corresponding in position to said fastening holes, each of said fasteners extending through a respective one of said fixing holes and engaging a corresponding one of said fastening holes.

4. The cutter as claimed in claim 3, wherein each of said fastening holes has a screw hole portion and a positioning hole portion which has a diameter larger than that of said screw hole portion, which communicates with said screw hole portion and which is located on an outer side of said screw hole portion, each of said fasteners having a threaded shank section threadedly engaged to said screw hole portion, and a positioning shank section embedded in said positioning hole portion and having a diameter larger than that of said threaded shank section, said positioning hole portion and said positioning shank section having a clearance smaller than that between said screw hole portion and said threaded shank section.

5. The cutter as claimed in claim 3, further comprising a plurality of positioning members, said rotary shaft further including a plurality of positioning holes each disposed between two adjacent ones of said fastening holes, said fixing holes in said cutting strip body being divided into a plurality of first fixing holes for extension of said fasteners respectively therethrough, and a plurality of second fixing holes corresponding in position to said positioning holes, respectively.

6. The cutter as claimed in claim 5, wherein each of said positioning members includes an embedded portion embedded in a respective one of said positioning holes, and a protruding portion protruding from said embedded portion and extending through a respective one of said second fixing holes, said embedded portion of each said positioning member having a diameter larger than that of the respective said second fixing hole, said protruding portion of each said positioning member and a periphery of the respective said second fixing hole having a clearance smaller than that between each of said fasteners and a periphery of the respective said first fixing hole.

7. The cutter as claimed in claim 1, wherein said blade edge of each of said cutting blades has an axial length (L1) larger than said offset length (D).

8. The cutter as claimed in claim 7, wherein each of said spacer sections formed between two adjacent ones of said cutting blades of one of said cutting strips has an axial length (L2) smaller than the sum of said offset lengths (D) of said portions of said cutting blades of the remaining said cutting strips that are staggered with said two adjacent ones of said cutting blades in the circumferential direction and that are at least partially aligned with said axial length (L2) in the circumferential direction.

9. The cutter as claimed in claim 8, wherein said blade edges of said cutting blades of each of said multi-blade cutting strips are respectively staggered with respect to said blade edges of said cutting blades of an adjacent leading one of said multi-blade cutting strips by said offset length (D) when said rotary shaft rotates.

10. The cutter as claimed in claim 7, wherein said multi-blade cutting strips are divided into two cutting strip groups, each of said cutting strip groups including a plurality of said multi-blade cutting strips, and wherein, in each of said cutting strip groups, each of said spacer sections formed between two adjacent ones of said cutting blades of one of said cutting strips having an axial length (L2) being not larger than the sum of said offset lengths (D) of said portions of said cutting blades of the remaining said cutting strips that are staggered with said two adjacent ones of said cutting blades in the circumferential direction and that are at least partially aligned with said axial length (L2) in the circumferential direction.

11. The cutter as claimed in claim 10, wherein said two cutting strip groups are disposed on two opposite sides of said rotary shaft, and said cutting blades of one of said cutting strip groups are aligned with said cutting blades of the other one of said cutting strip groups, respectively, along the circumferential direction.

12. The cutter as claimed in claim 11, wherein said blade edges of said cutting blades of each of said multi-blade cutting strips in each of said cutting strip groups are respectively staggered with respect to said blade edges of said cutting blades of an adjacent leading one of said multi-blade cutting strips in a corresponding said cutting strip group by said offset length (D).

13. The cutter as claimed in claim 1, wherein each of said longitudinal side edges is provided with said cutting blades.

14. The cutter as claimed in claim 13, wherein said shaft includes a plurality of circumferentially spaced-apart abutment portions disposed on and projecting outward from said outer surface thereof, each of said cutting blades further having a cutting blade body, each of said abutment portions abutting against said cutting blade bodies of said cutting blades located at the same said longitudinal side edge of a respective one of said multi-blade cutting strips.

15. The cutter as claimed in claim 1, wherein said shaft includes a plurality of circumferentially spaced-apart abutment portions disposed on and projecting outward from said outer surface thereof, each of said abutment portions having an abutment surface abutting against said cutting strip body of a respective one of said multi-blade cutting strips.

* * * * *